US008692716B2

(12) United States Patent
Biris et al.

(10) Patent No.: US 8,692,716 B2
(45) Date of Patent: Apr. 8, 2014

(54) NANO AND MICRO BASED ANTENNAS AND SENSORS AND METHODS OF MAKING SAME

(75) Inventors: Alexandru S. Biris, Little Rock, AR (US); Hussain Al-Rizzo, Little Rock, AR (US); Taha Elwi, Little Rock, AR (US); Daniel Rucker, Hot Springs, AR (US)

(73) Assignee: Board of Trustees of the University of Arkansas, Little Rock, AR (US)

( * ) Notice: Subject to any disclaimer, the term of this patent is extended or adjusted under 35 U.S.C. 154(b) by 745 days.

(21) Appl. No.: 12/371,769

(22) Filed: Feb. 16, 2009

(65) Prior Publication Data

US 2010/0097273 A1 Apr. 22, 2010

Related U.S. Application Data

(60) Provisional application No. 61/106,739, filed on Oct. 20, 2008.

(51) Int. Cl.
*H01Q 1/38* (2006.01)

(52) U.S. Cl.
USPC ..... 343/700 MS; 29/600; 29/592.1; 977/743; 977/767; 977/954; 977/950; 977/742; 343/700 R; 343/872; 343/895; 343/702; 257/E33.001

(58) Field of Classification Search
USPC ..... 29/601, 600, 592.1; 977/743, 767, 954, 977/950, 742, 762, 773; 343/700 MS, 700 R, 343/872, 895, 702; 235/435, 472.02; 257/E33.001
See application file for complete search history.

(56) References Cited

U.S. PATENT DOCUMENTS

| | | | | |
|---|---|---|---|---|
| 6,700,454 | B2 | 3/2004 | Yaniv et al. | |
| 7,051,945 | B2 | 5/2006 | Empedocles et al. | |
| 7,057,565 | B1 * | 6/2006 | Liu | 343/700 MS |
| 7,070,754 | B2 | 7/2006 | Smalley et al. | |
| 7,116,273 | B2 | 10/2006 | Morikawa et al. | |
| 7,205,940 | B2 * | 4/2007 | Anazawa et al. | 343/700 MS |
| 7,239,261 | B2 | 7/2007 | Fujieda et al. | |
| 7,241,496 | B2 | 7/2007 | Chen et al. | |
| 7,733,481 | B1 | 6/2010 | Bratkovski et al. | |
| 8,127,440 | B2 * | 3/2012 | Douglas | 29/846 |
| 2005/0249901 | A1 | 11/2005 | Yializis et al. | |

(Continued)

OTHER PUBLICATIONS

Pichitpong Soontornpipit, et al., "Design of Implantable Microstrip Antenna for Communication with Medical Implants," Aug. 2004, pp. 1944-1951, vol. 52, No. 8, IEEE Trans. Microwave Theory Tech.

(Continued)

*Primary Examiner* — Peter DungBa Vo
*Assistant Examiner* — Azm Parvez
(74) *Attorney, Agent, or Firm* — Morris, Manning & Martin, LLP; Tim Tingkang Xia, Esq.

(57) ABSTRACT

A method of fabricating an antenna. In one embodiment, the method includes the steps of providing a substrate treated with a plasma treatment, providing a nanoparticle ink comprising nanoparticles, painting the nanoparticle ink on the substrate to form an antenna member in which the nanoparticles are connected, determining a feed point of the antenna member, and attaching an feeding port onto the substrate at the feed point to establish a contact between the feeding port and the antenna member.

17 Claims, 7 Drawing Sheets

(56) References Cited

U.S. PATENT DOCUMENTS

| | | | | |
|---|---|---|---|---|
| 2006/0045988 | A1* | 3/2006 | Guo et al. | 427/569 |
| 2007/0048181 | A1 | 3/2007 | Chang et al. | |
| 2007/0176832 | A1 | 8/2007 | Qian et al. | |
| 2007/0236395 | A1 | 10/2007 | Sullivan et al. | |
| 2007/0257859 | A1 | 11/2007 | Lashmore et al. | |
| 2009/0104438 | A1* | 4/2009 | Lalli et al. | 428/329 |
| 2010/0140564 | A1* | 6/2010 | Overbreek et al. | 252/514 |

OTHER PUBLICATIONS

Kin-Lu Wong, "Compact and Broadband Microstrip Antennas," 2002, New York, John Wiley & Sons, Inc.

Constantine A. Balanis, "Antenna Theory: Analysis and Design," 3rd Edition, 2005, John Wiley & Sons, Inc, Hoboken, New Jersey.

P. J. Burke, et al., "Quantitative Theory of Nanowire and Nanotube Antenna Performance".

P. J. Burke, "Luttinger liquid theory as a model of the gigahertz electrical properties of carbon nanotubes," 2002, pp. 129-144, 2002, vol. 1, No. 3, IEEE Transactions on Nanotechnology.

P. J. Burke, "An RF Circuit Model for Carbon Nanotubes," Mar. 2003, pp. 55-58, vol. 2, No. 1, IEEE Transactions on Nanotechnology.

Stephen M. Goodnick, Jonathan Bird, "Quantum-Effect and Single-Electron Devices," Dec. 2003, pp. 368-385, vol. 2, No. 4, IEEE Transactions on Nanotechnology.

Mark J. Hagmann, "Isolated Carbon Nanotubes as High-Impedance Transmission Lines for Microwave through Terahertz Frequencies," Mar. 2005, pp. 289-296, vol. 4, No. 2, IEEE Transactions on Nanotechnology.

Arijit Raychowdhury, Kaushik Roy, "Modeling of Metallic Carbon-Nanotube Interconnects for Circuit.Simulations and a Comparison with Cu Interconnects for Scaled Technologies," Jan. 2006, pp. 58-65, vol. 25, No. 1, IEEE Transactions on Computer-Aided Design of Integrated Circuits and Systems.

George W. Hanson, "Current on an Infinitely-Long Carbon Nanotube Antenna Excited by a Gap Generator," Jan. 2006, pp. 76-81, vol. 54, No. 1, IEEE Transactions on Antennas and Propagation.

Tullio Rozzi, Davide Mencarelli, "Application of Algebraic Invariants to Full-Wave Simulators Rigorous Analysis of the Optical Properties of Nanowires," Feb. 2006, pp. 797-803, vol. 54, No. 2, IEEE Transactions on Microwave Theory and Techniques.

Giovanni Miano, Fabio Villone, "An Integral Formulation for the Electrodynamics of Metallic Carbon Nanotubes Based on a Fluid Model," Oct. 2006, pp. 2713-2724, vol. 54, No. 10, IEEE Transactions on Antennas and Propagation.

Jin Hao, George W. Hanson, "Infrared and Optical Properties of Carbon Nanotube Dipole Antennas," Nov. 2006, vol. 5, No. 6, IEEE Transactions on Nanotechnology.

George W. Hanson, Paul Smith, "Modeling the Optical Interaction between a Carbon Nanotube and a Plasmon Resonant Sphere," Nov. 2007, pp. 3063-3069, vol. 55, No. 11, IEEE Transactions on Antennas and Propagation.

James Baker-Jarvis, et al., "Dielectric Resonator Method for Measuring the Electrical Conductivity of Carbon Nanotubes from Microwave to Millimeter Frequencies," Jun. 2007, 4 pages, vol. 2007, Journal of Nanomaterials.

D.S. Hecht, et al., "Electronic Properties of Carbon Nanotube/Fabric Composites," Sep. 2005, pp. 60-63, vol. 7, Current Applied Physics, Elsevier.

A Biswas et al., Networks of ultra-fine Ag nanocrystals in a Teflon AF matrix by vapour phase e-beam-assisted deposition. Nanotechnology, 2007, p. 1-6, vol. 18.

A Biswas et al., Large broadband visible to infrared plasmonic absorption from Ag Nanoparticles with a fractal structure embedded in a Teflon AF matrix, Applied Physics Letters, 2006, p. 013103-1-013103-3, vol. 88.

A. Biswas et al.,"Controlled Generation of Ni Nanoparticles in the Capping Layers of Teflon AF by Vapor-Phase Tandem Evaporation," Nano Letters, 2003, 3 (1), pp. 69-73.

Biswas, A. et al., "Nanocomposites of Vapour Phase Deposited Teflon AF Containing Ni Clusters," Solid State Phenom., 2003: 94, 285.

T. Hasell et al., Sliver Nanoparticle Impregnated Polycarbonate Substrates for Surface Enhanced Raman Spectroscopy, Advanced Functional Material, 2008, 18, 1265-1271.

* cited by examiner

NANO AND MICRO BASED ANTENNAS AND SENSORS AND METHODS OF MAKING SAME

CROSS-REFERENCE TO RELATED PATENT APPLICATION

This application claims the priority to and the benefit of, pursuant to 35 U.S.C. §119(e), U.S. provisional patent application Ser. No. 61/106,739, filed Oct. 20, 2008, entitled "NANO AND MICRO BASED ANTENNAS AND SENSORS," by Rizzo et al., the content of which is incorporated herein in its entirety by reference.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference were individually incorporated by reference. In terms of notation, hereinafter, "[n]" represents the nth reference cited in the reference list. For example, [1] represents the 1st reference cited in the reference list, namely, P. Soontornpipit, C. M. Furse, and Y. C. Chung, "Design of Implantable Microstrip Antenna for Communication with Medical Implants," IEEE Trans. Microwave Theory Tech., vol. 52, no. 8, pp. 1944-1951, August 2004.

STATEMENT OF FEDERALLY-SPONSORED RESEARCH

This invention was made with government support under Grant Nos. CNS-0619069 and EPS-0701890 awarded by National Science Foundation (NSF). The government has certain rights to the invention.

FIELD OF THE INVENTION

The present invention generally relates to an antenna, and more particularly to a an antenna formed with an ink of carbon nanotubes and a method of fabricating same.

BACKGROUND OF THE INVENTION

The classical electromagnetic theory is governed by Maxwell's equations that describe the interaction of the electromagnetic radiation with materials through the electrical properties such as the conductivity, the permittivity, and the permeability of the materials. The electrical properties of carbon nanotubes (CNTs), however, are governed by the quantum theory.

The use of CNTs to fabricate an antenna has been reported. Most of these studies were focused on understanding the physics of the current flows in the nanotubes, and evaluating the impedance and the field distribution around the CNTs. There are many ways to explain the physics behind the radiation that comes out from a CNT antenna and the effective boundary conditions with respect to the aspect ratio. In the form of two-sided impedance boundary conditions for the linear electrodynamics of single and multi wall CNTs, the impedance results from the dynamic conductivity of the CNTs, which is obtained for different CNT zigzag, armchair, and chiral in different approaches. The phase velocities and the slow-wave coefficients of surface waves in the CNTs were explained for a wide frequency range, from the microwave to the ultraviolet regimes. Attenuation and retardation in metallic and semiconductor CNTs were considered in all the mentioned approaches.

The electronic wave motion in the CNTs is at a plasmatic velocity that is much less then the velocity of light in the free space by a factor of (0.01-0.02), which makes the wave length of the electromagnetic radiation looks shorter then the free space wave length with the same frequency. Because the CNTs are in the nano-scale length and diameter, it is very difficult to operate them as a traditional antenna in the microwave range. There are attempts to make the length of a CNT as long as possible, but the longest CNT available is still around few hundreds micrometers, which still does not solve the problem.

Therefore, a heretofore unaddressed need exists in the art to address the aforementioned deficiencies and inadequacies.

SUMMARY OF THE INVENTION

In one aspect, the present invention relates to a method of fabricating an antenna. The antenna can be characterized with a bandwidth, Q factor, capacitance, resistance, inductance, capacitive and inductive reactance. In one embodiment, the method includes the steps of providing a substrate treated with a plasma treatment, providing a nanoparticle ink comprising nanoparticles, painting the nanoparticle ink on the substrate to form an antenna member in which the nanoparticles are connected to each other, determining a feed point of the antenna member, and attaching an feeding port onto the substrate at the feed point to establish a contact between the feeding port and the antenna member.

In one embodiment, the nanoparticle ink further comprises a solvent adapted for suspending the nanoparticles and a crosslinked component adapted for connecting the nanoparticles to each other. The crosslinked component in one embodiment includes a chemical bond of functional groups. The nanoparticle ink is made of transparent or non-transparent materials.

In one embodiment, the nanoparticles comprise carbon nanotubes, carbon nanofibers, fullerenes, or a combination of them, where the carbon nanotubes comprises single-walled carbon nanotubes, multi-walled carbon nanotubes, or a combination of them. The nanoparticles are connected to each other through van der Waals forces, electrostatic forces, functional groups, biological systems, or a combination of them.

The antenna member is formed to have a desired geometric shape and dimensions capable of resonating at frequencies ranging from about 500 Hz to about 500 THz. In one embodiment, the substrate is made of a dielectric material, where the dielectric material comprises plastic, polymer, fabric, wood, ceramic, glass, or a combination of them. The feeding port comprises a coaxial cable connector.

In one embodiment, the painting step is performed using electrospray, ink jet printing, layer deposition, micro and nano fabrication, or chemical vapor deposition.

In another aspect, the present invention relates to an antenna. In one embodiment, the antenna has a substrate treated with a plasma treatment, an antenna member formed with a nanoparticle ink on the substrate, and a feeding port attached to the substrate and substantially in contact with the antenna member, where the nanoparticle ink comprises nanoparticles, and the nanoparticles in the antenna member are connected to each other.

In one embodiment, the nanoparticles comprise carbon nanotubes, carbon nanofibers, fullerenes, or a combination of them, where the carbon nanotubes comprises single-walled carbon nanotubes, multi-walled carbon nanotubes, or a combination of them. The nanoparticles are connected to each other through van der Waals forces, electrostatic forces, functional groups, biological systems, or a combination of them.

In one embodiment, the nanoparticle ink further comprises a solvent adapted for suspending the nanoparticles and a crosslinked component adapted for connecting the nanoparticles to each other. The crosslinked component in one embodiment includes a chemical bond of functional groups. The nanoparticle ink is made of transparent or non-transparent materials.

The antenna member can be formed with using electrospray, ink jet printing, layer deposition, micro and nano fabrication, or chemical vapor deposition. Additionally, the antenna member is formed to have a desired geometric shape and dimensions capable of resonating at frequencies ranging from about 500 Hz to about 500 THz. The antenna is characterized with a bandwidth, Q factor, capacitance, resistance, inductance, capacitive and inductive reactance.

In one embodiment, the feeding port comprises a coaxial cable connector. The substrate is made of a dielectric material. The dielectric material comprises plastic, polymer, fabric, wood, ceramic, glass, or a combination of them. In one embodiment, the substrate is formed to be flexible.

Furthermore, the antenna further comprises a ground member formed such that the substrate is positioned between the antenna member and the ground member, where the ground member is formed of an electrical conductive material.

In yet another aspect, the present invention relates to an antenna. In one embodiment, the antenna includes an antenna member formed with a nanoparticle ink, where the nanoparticle ink comprises a solvent, nanoparticles suspended in the solvent, and a crosslinked component. The nanoparticles in the antenna member are connected to each other through the crosslinked component. The nanoparticle ink is mixable with polymers, ceramics, metals, biological systems including proteins, organic and inorganic dyes, META materials, dialectic and non dialectic materials.

In one embodiment, the antenna member is formed on a substrate of an insulating material, a circuit board, a device, a surface of an organic substance, a surface of a micro organism, a plant, or a skin of a living subject. Additionally, the antenna member can be implanted in a living subject, a plant, or the like.

In a further aspect, the present invention relates to a sensor for detection of radiation in its surrounding environment. In one embodiment, the sensor has a sensor member formed with a nanoparticle ink, where the nanoparticle ink comprises a solvent, nanoparticles suspended in the solvent, and a crosslinked component. The nanoparticles in the sensor member are connected to each other through the crosslinked component. The sensor member is formed on a substrate of an insulating material, a circuit board, a device, a surface of an organic substance, a surface of a micro organism, a plant, or a skin of a living subject. Additionally, the sensor body is implantable in a living subject or a plant.

These and other aspects of the present invention will become apparent from the following description of the preferred embodiment taken in conjunction with the following drawings, although variations and modifications therein may be affected without departing from the spirit and scope of the novel concepts of the disclosure.

DETAILED DESCRIPTION OF THE INVENTION

Figure 1:
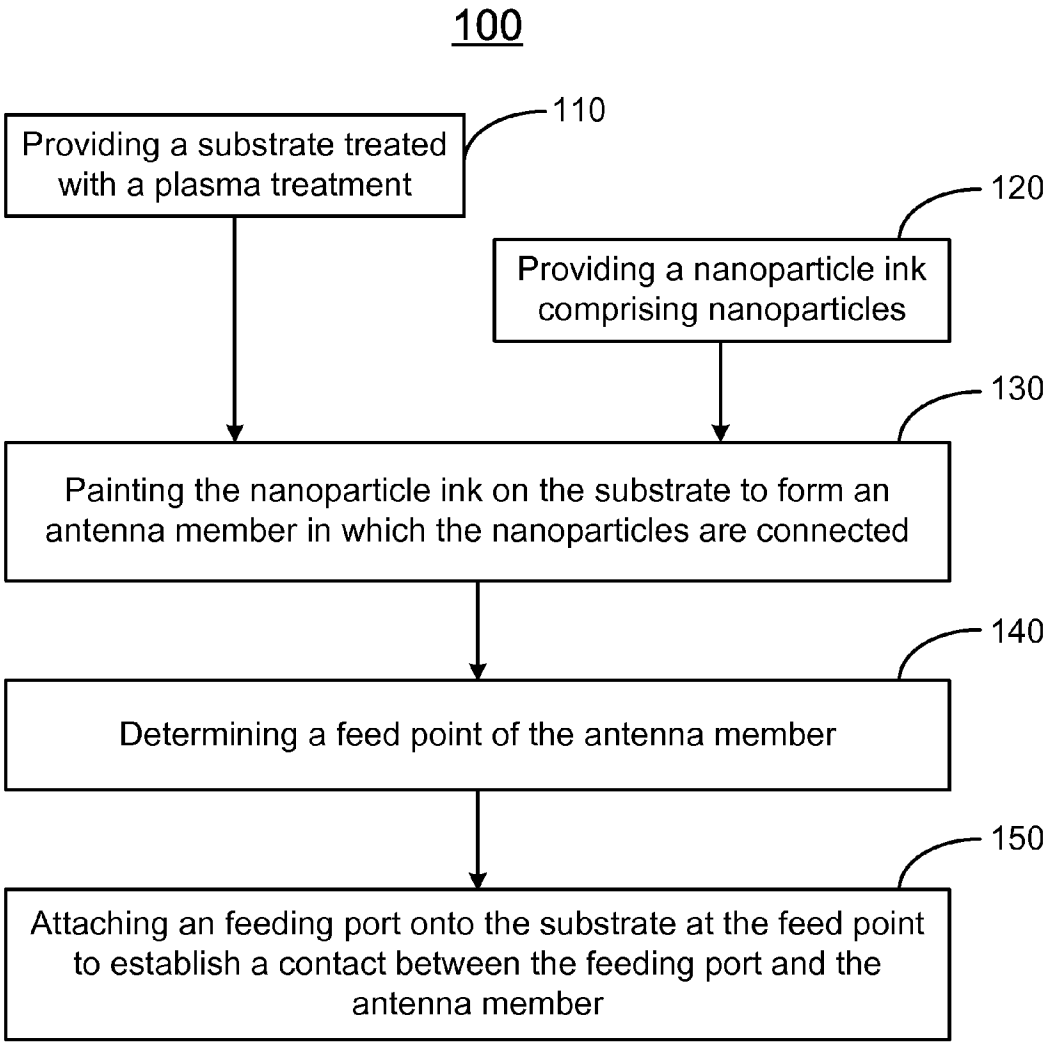
FIG. 1 shows a flowchart associating with a method for fabricating an antenna according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "antenna" refers to a transducer designed to transmit or receive electromagnetic waves. In other words, antennas convert electromagnetic waves into electrical currents and vice versa. Antennas are used in systems such as radio and television broadcasting, point-to-point radio communication, wireless LAN, radar, and space exploration. In air, those signals travel close to the speed of light in vacuum and with a very low transmission loss. The signals are absorbed when propagating through more conducting materials, such as concrete walls, rock, etc. When encountering an interface, the waves are partially reflected and partially transmitted through.

Physically, an antenna is an arrangement of conductors that generate a radiating electromagnetic field in response to an applied alternating voltage and the associated alternating electric current, or can be placed in an electromagnetic field so that the field will induce an alternating current in the antenna and a voltage between its terminals.

There are several critical parameters affecting an antenna's performance that can be adjusted during the design process. These are resonant frequency, Q factor, impedance, gain, aperture or radiation pattern, polarization, efficiency and bandwidth. Transmit antennas may also have a maximum power rating, and receive antennas differ in their noise rejection properties.

As used herein, "cabon nanotube" or its acronym "CNT" refers to an allotrope of carbon with a nanostructure that can have a length-to-diameter ratio greater than 1,000,000. These cylindrical carbon molecules have novel properties that make them potentially useful in many applications in nanotechnology, electronics, optics and other fields of materials science, as well as potential uses in architectural fields. They exhibit extraordinary strength and unique electrical properties, and are efficient conductors of heat. CNTs can be categorized as single-wall carbon nanotubes (SWCNTs) and multi-wall carbon nanotubes (MWCNTs). The former refers to a carbon nanotube having a structure with a single hexagon mesh tube (graphene sheet), while the latter refers to a carbon nanotube made of multilayer graphene sheets.

The nature of the bonding of a nanotube is described by applied quantum chemistry, specifically, orbital hybridization. The chemical bonding of nanotubes is composed entirely of $sp^2$ bonds, similar to those of graphite. This bonding structure, which is stronger than the $sp^3$ bonds found in diamonds, provides the molecules with their unique strength. Nanotubes naturally align themselves into "ropes" held together by Van der Waals forces. Under high pressure, nanotubes can merge together, trading some $sp^2$ bonds for $sp^3$ bonds, giving the possibility of producing strong, unlimited-length wires through high-pressure nanotube linking.

CNT's conductivity: a CNT is a ballistic transporter whose conductivity depends on its length and diameter. In practice, it is difficult to form all CNTs with the same length and diameter. In other words, it is difficult to make all CNTs having a specific value of conductivity. Generally, the electrical properties of CNTs depend on the shape of rolling the graphite sheet. It has been reported that the RF conductivity of a single CNT is proximately 0.08×107 S/m, which is about five times higher than copper's conductivity. This makes the simulation difficult because one can't consider a specific conductivity for a single CNT. For the sake of simulation, it is assumed that the conductivity of the CNT is corresponding to the conductivity of a perfect electric conductor (PEC).

CNT's resistance: The electrical resistance of the CNT is in the form of $$\sigma_{cn} = \frac{4e^2 L_{mfp}}{\pi h a},$$

where a is the CNT radius, $L_{mfp}$ is the mean free path of the electron on the π-bond in the CNT that is in the form of $$L_{mfp} = \tau v_F,$$

where $v_F$ is the plasmon velocity (i.e., the phase velocity) and for a quantum wire case $L_{mfp} > 2a$. In fact, it is difficult to get all CNTs having a specific length or a specific diameter, even the shape of a CNT. However, a specific number of shells, such as single wall and multiwall structure, of the CNT can be obtained. The resistance is considered in this disclosure as an average resistance for SWCNTs.

The high aspect ratio of a single CNT makes its resistance very high, which is in the order of a few hundreds Ohms Even though the CNT has a very high conductivity, this conductivity is still not enough to come up with the resistance. It is difficult to fabricate a CNT antenna governed by the traditional physics of the Maxwell's equations at an microscopic level. The CNT antenna has to be described by a quantum theory at the atomic level of the CNT based on the quantum conductance at a specific plasmatic wavelength.

As disclosed in the present invention, by using a CNT ink to paint a substrate surface to form an antenna patch with a desired shape, a punch of the CNTs as a single structure having a low resistance is obtained, because the inner connections of the CNTs inside the structure reduces the effective resistance for all the inter patch.

CNT's length: The length of the CNT is in the range of a few micrometers on average. To design an antenna working in the microwave range (several centimeters), a length of the antenna needs to be in a order of few centimeters, which make it very difficult to fabricate an antenna using a single CNT to have a length of few centimeters. One of the objectives of the present invention is to fabricate a CNT antenna having a desirable shape and dimensions using a CNT ink.

Because of the excellent electrical properties of the CNTs, the electron motion is kept inside the CNT without scattering or diffusive, which increase the efficiency of the antenna. Additionally, the transition of the electrons along this path as a quantum wire happens at quantum level, which means that the antenna's length does not depend on that half wavelength condition exactly.

In accordance with the purposes of this invention, as embodied and broadly described herein, this invention, in one aspect, relates to a CNT antenna and a method of fabricating same. In one embodiment, the antenna includes a network structure having a plurality of CNTs electrically connected to each other. Doing so could allow the CNTs to be connected to make a long path for the electron motion in the same CNT to satisfy the radiation condition, half the wavelength of the radiation for any antenna.

Referring to FIG. 1, a flowchart 100 associated with a method of fabricating a CNT antenna is shown according to one embodiment of the present invention. In this exemplary embodiment, the method includes the following steps: at step 110, a substrate treated with a plasma treatment is provided. To attach a CNT ink onto a substrate of a dielectric material to form the antenna, the substrate is first treated with a plasma treatment to increase the hydrophobic properties of the surface of the substrate. The substrate is made of a dielectric material. The dielectric material include plastic, polymer, fabric, wood, ceramic, glass, or the like.

At step 120, a nanoparticle ink made of nanoparticles is provided. In one embodiment, the nanoparticles comprise carbon nanotubes, carbon nanofibers, fullerenes, or a combination of them, where the carbon nanotubes comprises single-walled carbon nanotubes, multi-walled carbon nanotubes, or a combination of them. The nanoparticles are connected to each other through van der Waals forces, electrostatic forces, functional groups, biological systems, or a combination of them. Other types of nanoparticles can also utilized to practice the present invention. The CNT ink is formed at a specific amount of CNTs so that it is stable and suitable for painting on a substrate. The nanoparticle ink may also include a solvent adapted for suspending the nanoparticles therein, and a crosslinked component including a chemical bond of functional groups adapted for connecting the nanoparticles to each other. The nanoparticle ink is transparent or non-transparent.

In practice, there is no specific order to perform steps 110 and 120. Steps 110 and 120 can be performed at the same time or different times.

At step 130, the nanoparticle ink is painted on the substrate to form an antenna member in which the nanoparticles are connected to each other. The painting step can be performed using electrospray, ink jet printing, layer deposition, micro and nano fabrication, or chemical vapor deposition, or the like. The painting step can be repeated until the antenna member is formed to have a desired geometric shape and dimensions capable of resonating at frequencies ranging from about 500 Hz to about 500 THz.

At step 140, a feed point of the antenna member is determined. The position of the feeding point is determined such that any shift from this position changes the reflection coefficient. To feed the painted CNTs, panting has to use a material to make a physical connection to the feeding port. The silver past is a good conductor and it drays at the room temperature also does not have any effect on the CNTs, where other kind of a regular solders have to be under high temperature and effect on the CNTs.

At step 150, an feeding port is attached onto the substrate at the feed point so as to establish a contact between the feeding port and the antenna member. The feeding port can be a coaxial cable connector in one embodiment.

Figure 2:
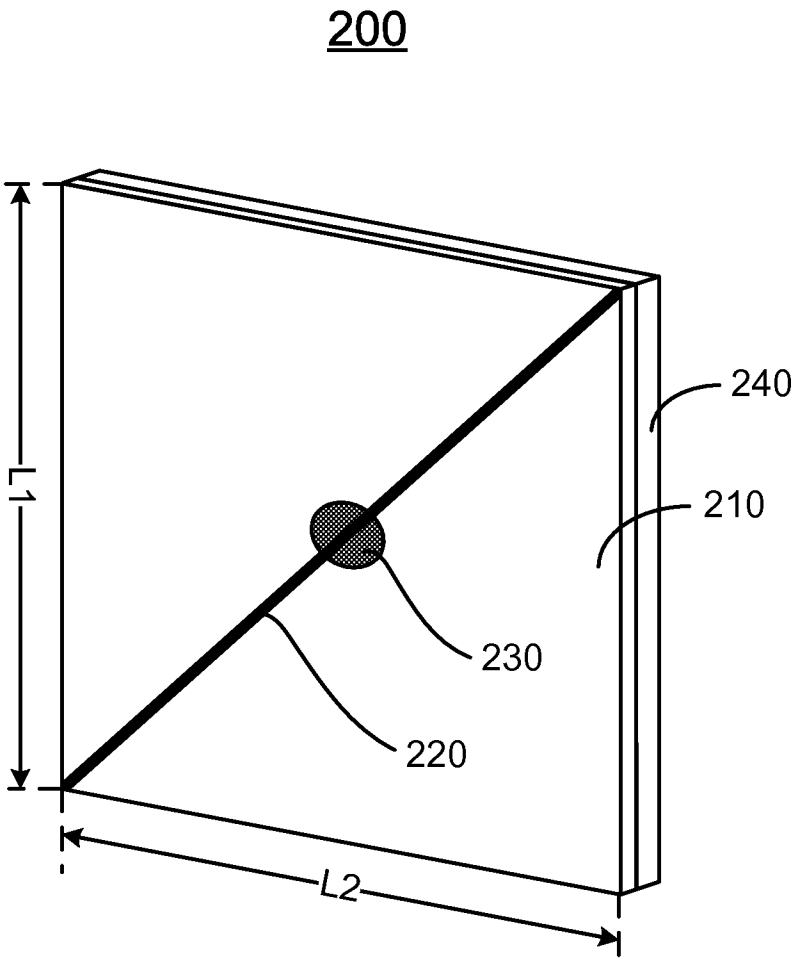
FIG. 2 shows schematically an antenna according to one embodiment of the present invention.

FIG. 2 shows an antenna 200 made of nanoparticles according to one embodiment of the present invention. The antenna 200 can be characterized with a bandwidth, Q factor, capacitance, resistance, inductance, capacitive and inductive reactance. In the embodiment, the antenna 200 has a substrate 210 that is treated with a plasma treatment, an antenna member 220 formed with a nanoparticle ink on the substrate 210. The nanoparticle ink is formed with nanoparticles, such as carbon nanotubes, carbon nanofibers, fullerenes, or the like. The carbon nanotubes can be single-walled carbon nanotubes, multi-walled carbon nanotubes, or a combination of them. The nanoparticles in the antenna member 220 are connected to each other through van der Waals forces, electrostatic forces, functional groups, biological systems, a combination of them, or the like.

Figure 3:
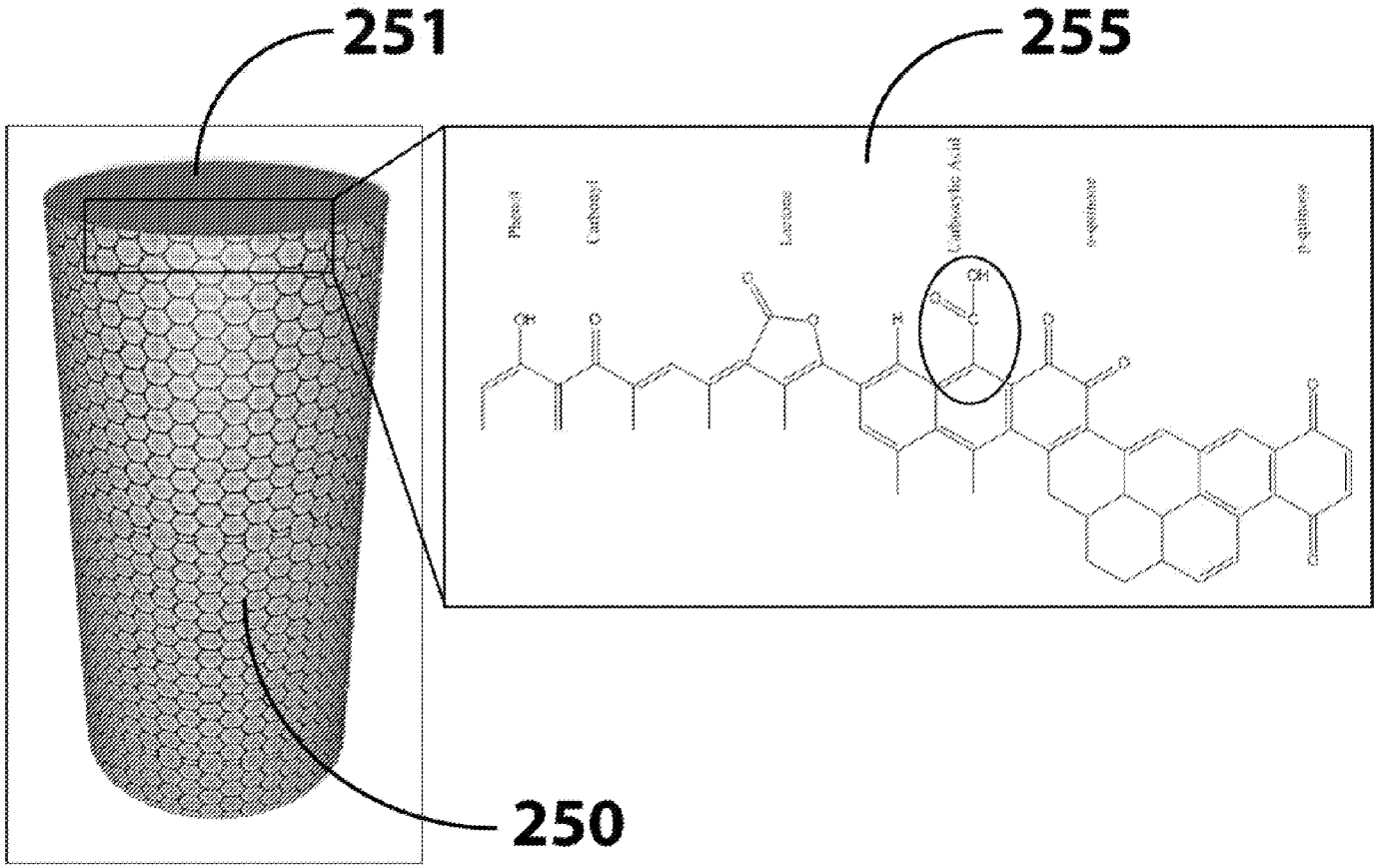
FIG. 3 shows schematically a functional group at an open end of a CNT.

In one embodiment, the nanoparticle ink further includes a solvent adapted for suspending the nanoparticles therein and a crosslinked component adapted for connecting the nanoparticles to each other. As shown in FIG. 3. in one embodiment, the nanotube 250 has an open end potion 251. The open end portion 251 includes a chemical bond of functional groups 255 for connecting to another nanotube. The nanoparticle ink can be transparent or non-transparent. The use the functional groups enable one to get many CNTs connected at their ends to form a long path for current to flow in order to cause the antenna to radiate.

In one embodiment, the antenna member 220 is formed with using electrospray, ink jet printing, layer deposition, micro and nano fabrication, or chemical vapor deposition. The antenna member 220 is formed to have a desired geometric shape and dimensions capable of resonating at frequencies ranging from about 500 Hz to about 500 THz. In another embodiment, a spray-on antenna can be fabricated by separating a small template from a larger painted area, a transparent antenna can be made by cutting out and isolating an area of window film. This type of antennas could receive a variety of signals such as amplitude modulation, frequency modulation, global positioning system, cellular telephone and personal communications systems.

The substrate 210 is made of a dielectric material, where the dielectric material comprises plastic, polymer, fabric, wood, ceramic or glass. The substrate 210 can be flexible. The substrate 210 can be in any geometric shape. In the exemplary embodiment as shown in FIG. 2, the substrate 210 is formed in a rectangle/square having a length, L1 and a width, L2, where the values of L1 and L2 can be same or different.

Furthermore, the antenna 200 has a feeding port 230 attached to the substrate 210 and substantially in contact with the antenna member 220. The feeding port 230 can be a coaxial cable connector. Additionally, the antenna 200 may also have a ground member 240 formed such that the substrate 210 is positioned between the antenna member 220 and the ground member 240. The ground member 240 is formed of an electrically conductive or nonconductive material.

Figure 4:
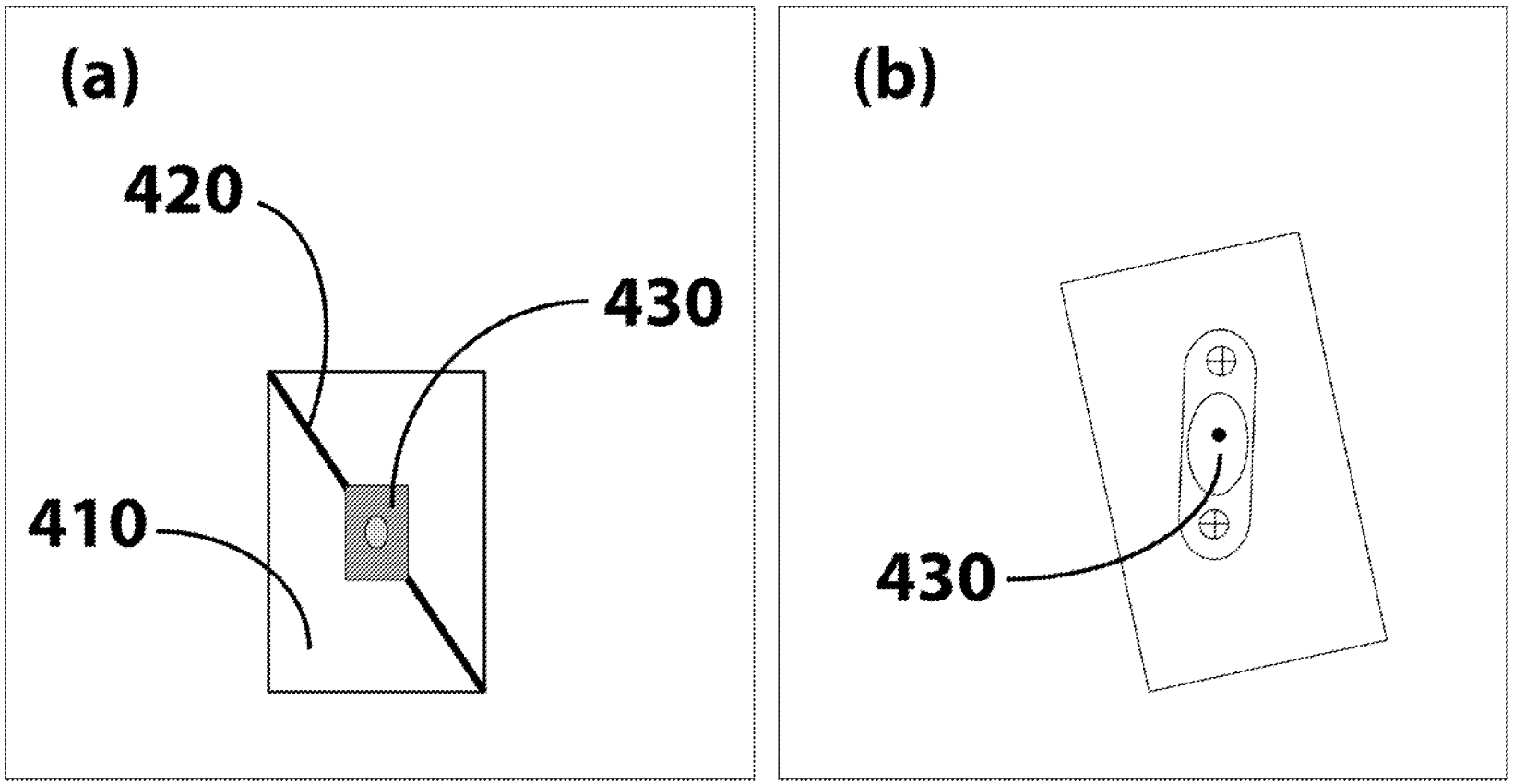
FIG. 4 shows different views (a) and (b) of a CNT antenna according to one embodiment of the present invention.
Figure 5:
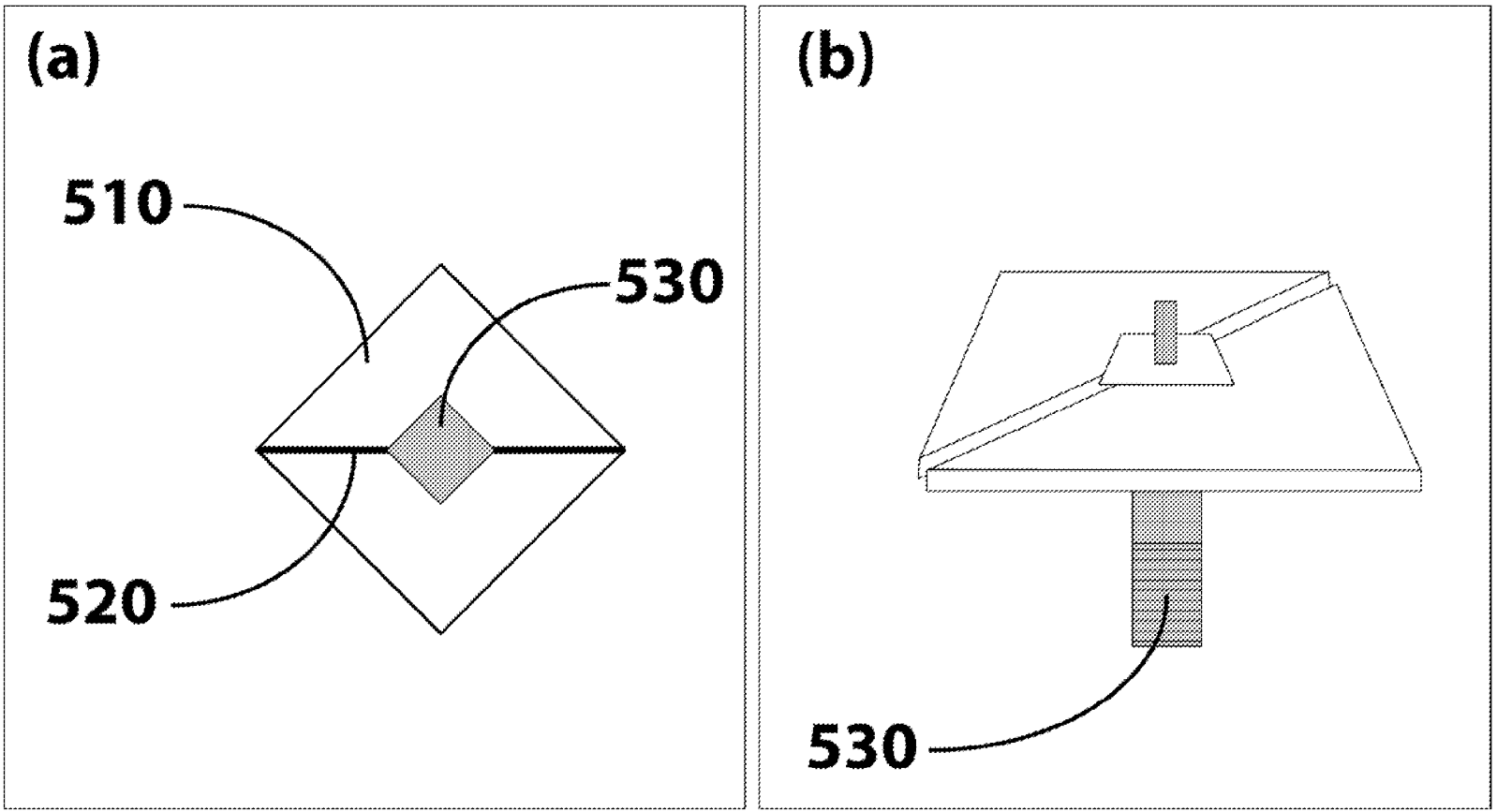
FIG. 5 shows different views (a) and (b) of a CNT antenna according to another embodiment of the present invention.

FIGS. 4 and 5 show two antennas 400 and 500 made of nanotubes according to embodiments of the present invention. Each antenna 400/500 has a substrate 410/510, an antenna member 420/520 formed of a CNT ink on the substrate 410/510, and a feeding port 430/530 at a feeding point and attached to the substrate 410/510 and being substantially in contact with the antenna member 420/520. In this exemplary embodiment shown in FIG. 5, the feeding port 530 is corresponding to a coaxial cable connector.

As shown in FIGS. 4 and 5, the CNT ink/paint for fabricating the antenna is opaque. Additionally, the CNT ink/pain can also be made of a transparent material. Transparent antennas is unobtrusive and can be installed on vehicle windshields. Military applications dictate like very large apertures for their antennas, and a windshield is often the largest uninterrupted surface on a vehicle that is available for mounting such a device. Furthermore, these devices include films embedded into or placed over a windshield or a window to form a receiver. Automobile windows are coated with a metal-oxide film, this material currently serves three objectives and are safety laminate to hold the glass together during an accident, as protection for the vehicle's interior and occupants from ultraviolet and infrared rays, and as a demister or defogger when a current passes through it.

Figure 6:
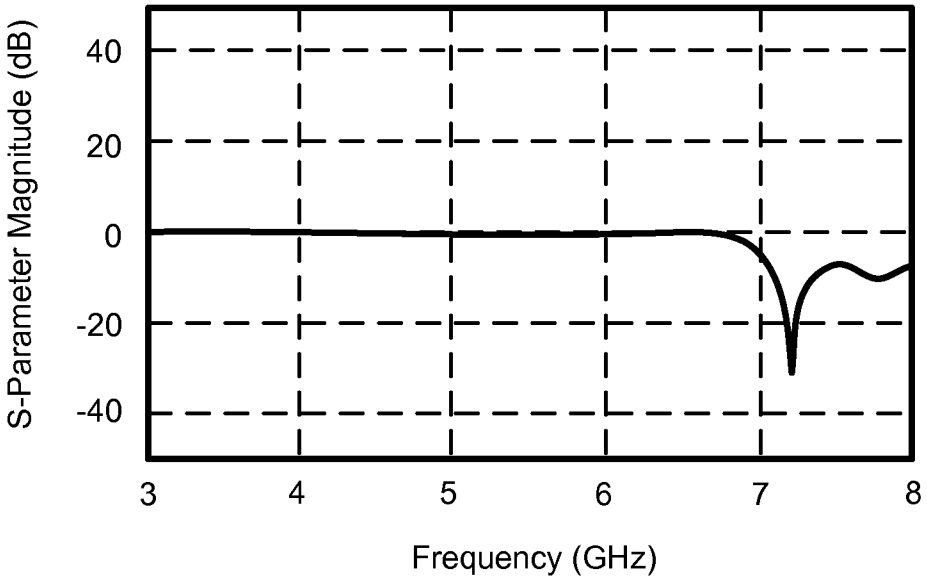
FIG. 6 shows a scattering parameter ($S_{1,1}$) vs frequency of a CNT antenna according to one embodiment of the present invention.
Figure 7:
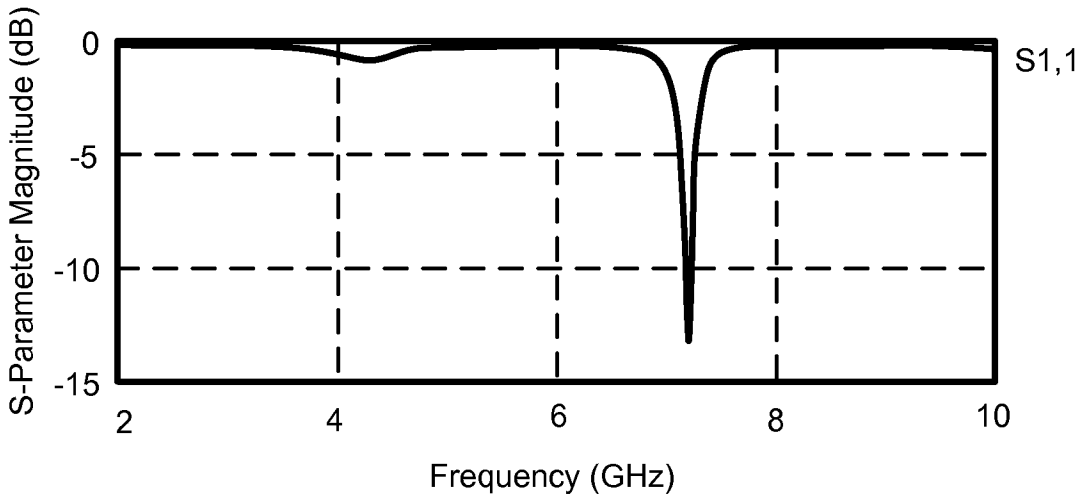
FIG. 7 shows a scattering parameter ($S_{1,1}$) vs frequency of a CNT antenna according to another embodiment of the present invention.

FIGS. 6 and 7 show a scattering parameter ($S_{1,1}$) vs frequency of a CNT antenna according to two embodiments of the present invention.

According to the invention. the antennas can be applied directly to walls, windows, clothes, skin or any fabric shelters, allowing military commanders and relief workers to set up communications networks quickly, for biomedical applications, for body area network, and sensors set up, or for mobile communication in general. The antenna of the present invention can find many applications in a wide spectrum of fields. For example, in transporting, establishing and maintaining communication systems for military and humanitarian operations are always a logistics balance among weight, cost, and space considerations. The ability to use any convenient surface as a mount base for the antenna provides planners with additional flexibility when deployed in areas that are devastated or lack infrastructure.

One aspect of the present invention provides a nanoparticle ink usable for making an antenna. The nanoparticle ink contains a solvent, nanoparticles suspended in the solvent; and a crosslinked component, where the nanoparticles in the antenna member are connected to each other through the crosslinked component. The nanoparticle ink is mixable with a polymers, ceramics, metals, proteins, organic and inorganic dyes, META materials, dialectic and non dialectic materials.

Another aspect of the present invention provides a sensor for detection of radiation in its surrounding environment. In one embodiment, the sensor has a sensor member formed with a nanoparticle ink, where the nanoparticle ink comprises nanoparticles, and a crosslinked component, where the nanoparticles in the antenna member are connected to each other. The sensor member is formed on a substrate of an insulating material, a circuit board, a device, a surface of an organic substance, a surface of a micro organism, a plant, or a skin of a living subject. The sensor member is implantable in a living subject or a plant.

The present invention, among other thing, discloses a CNT-based antenna for wireless communications, sensors, and RFID. These antenna operates at frequencies ranging from about 500 hertz to near infrared. The antenna is not corroded or degraded due to the environment. The antenna may utilize a flexible substrate or a rigid substrate. The CNT-based conducting patch or wire can be transparent or non-transparent.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

REFERENCES LIST

[1] P. Soontornpipit, C. M. Furse, and Y. C. Chung, "Design of Implantable Microstrip Antenna for Communication with Medical Implants," IEEE Trans. Microwave Theory Tech., vol. 52, no. 8, pp. 1944-1951, August 2004.

[2] K. L. Wong, Compact Microstrip Antennas, Compact and Broadband Microstrip Antennas, John Wiley & Sons, New York, 2002.

[3] C. A. Balanis. *Antenna Theory: Analysis and Design, 3rd Edition,* John Wiley & Sons, Inc, Hoboken, N.J., 2005.

[4] P. J. Burke, S. Li, Z. Yu, "Quantitative Theory of Nanowire and Nanotube Antenna Performance"

[5] P. J. Burke, "Luttinger liquid theory as a model of the gigahertz electrical properties of carbon nanotubes," IEEE Transactions on Nanotechnology, vol. 1, no. 3, pp. 129-144, 2002.

[6] P. J. Burke, "An RF Circuit Model for Carbon Nanotubes," IEEE Transactions on Nanotechnology, Vol. 2, No. 1, March 2003.

[7] Stephen M. Goodnick, Jonathan Bird, "Quantum-Effect and Single-Electron Devices," IEEE Transactions on Nanotechnology, Vol. 2, No. 4, December 2003.

[8] Mark Joseph Hagmann, "Isolated Carbon Nanotubes as High-Impedance Transmission Lines for Microwave through Terahertz Frequencies," IEEE Transactions on Nanotechnology, Vol. 4, No. 2, March 2005.

[9] Arijit Raychowdhury, Kaushik Roy, "Modeling of Metallic Carbon-Nanotube Interconnects for Circuit Simulations and a Comparison with Cu Interconnects for Scaled Technologies," IEEE Transactions on Computer-Aided Design Of Integrated Circuits and Systems, Vol. 25, No. 1, January 2006.

[10] George W. Hanson, "Current on an Infinitely-Long Carbon Nanotube Antenna Excited by a Gap Generator," IEEE Transactions on Antennas and Propagation, Vol. 54, No. 1, January 2006.

[11] Tullio Rozzi, Davide Mencarelli, "Application of Algebraic Invariants to Full-Wave Simulators Rigorous Analysis of the Optical Properties of Nanowires," IEEE Transactions on Microwave Theory and Techniques, Vol. 54, No. 2, February 2006.

[12] Giovanni Miano, Fabio Villone, "An Integral Formulation for the Electrodynamics of Metallic Carbon Nanotubes Based on a Fluid Model," IEEE Transactions on Antennas and Propagation, Vol. 54, No. 10, October 2006.

[13] Jin Hao, George W. Hanson, "Infrared and Optical Properties of Carbon Nanotube Dipole Antennas," IEEE Transactions on Nanotechnology, Vol. 5, No. 6, November 2006.

[14] George W. Hanson, Paul Smith, "Modeling the Optical Interaction between a Carbon Nanotube and a Plasmon Resonant Sphere," IEEE Transactions On Antennas And Propagation, Vol. 55, No. 11, November 2007.

[15] James Baker-Jarvis, Michael D. Janezic, John H. Lehman "Dielectric Resonator Method for Measuring the Electrical Conductivity of Carbon Nanotubes from Microwave to Millimeter Frequencies," Journal of Nanomaterials, Volume 2007, Article ID 24242, 4 pages doi: 10.1155/2007/24242.

[16] D. S. Hecht, L. Hu, G. Gruner. "Electronic Properties of Carbon Nanotube/Fabric Composites," Current Applied Physics, Elsevier, September 2005.

What is claimed is:

1. An antenna, comprising:

(a) a substrate treated with a plasma treatment;

(b) an antenna member made of a nanoparticle ink having an electrical conductivity about that of copper deposited on the substrate, wherein the antenna member functions as a transducer configured to transmit electromagnetic waves, wherein the antenna member also functions as a sensor and reacts to an external stimulus by changing at least one of conductivity, permittivity, and permeability of the antenna member, wherein the nanoparticle ink comprises conducting nanotubes, and wherein each of the nanotubes has an open end portion including a functional group that is chemically bonded with the functional group of another nanotube of the nanotubes such that the nanotubes in the antenna member are connected through the chemical bonding of the functional groups to form a single conductive structure having a length in an order of centimeters and such that the antenna member operates in the microwave range; and (c) a feeding port attached to the substrate and in contact with the antenna member.

2. The antenna of claim 1, wherein the nanotubes comprise carbon nanotubes.

3. The antenna of claim 2, wherein the carbon nanotubes comprises single-walled carbon nanotubes, multi-walled carbon nanotubes, or a combination of them.

4. The antenna of claim 1, wherein the nanoparticle ink further comprises a solvent adapted for suspending the nanotubes therein.

5. The antenna of claim 1, wherein the antenna member is formed with using electrospray, ink jet printing, layer deposition, micro and nano fabrication, or chemical vapor deposition.

6. The antenna of claim 1, wherein the antenna member is formed to have a desired geometric shape and dimensions capable of resonating at frequencies ranging from about 500 Hz to about 500 THz.

7. The antenna of claim 1, wherein the feeding port comprises a coaxial cable connector.

8. The antenna of claim 1, wherein the substrate is made of a dielectric material, wherein the dielectric material comprises plastic, polymer, fabric, wood, ceramic, glass, or a combination of them.

9. The antenna of claim 8, wherein the substrate is flexible.

10. The antenna of claim 1, being characterized with a bandwidth, Q factor, capacitance, resistance, inductance, capacitive and inductive reactance.

11. The antenna of claim 1, further comprising a ground member formed such that the substrate is positioned between the antenna member and the ground member.

12. The antenna of claim 11, wherein the ground member is formed of an electrical conductive.

13. An antenna, comprising an antenna member made of a nanoparticle ink deposited on a substrate made of a dielectric host medium, wherein the antenna member is a transducer configured to transmit electromagnetic waves, wherein the nanoparticle ink comprises:

(a) a solvent; and (b) nanotubes suspended in the solvent, wherein each of the nanotubes has an open end portion including a functional group that is chemically bonded with the functional group of another nanotube of the nanotubes;

wherein the nanotubes in the antenna member are connected to each other through the chemical bonding of the functional groups and form a single conductive structure having a length in an order of centimeters, wherein the antenna member operated in the microwave range.

14. The antenna of claim 13, wherein the nanoparticle ink is mixable with a polymers, ceramics, metals, proteins, organic and inorganic dyes, metamaterials, dielectric and non dielectric materials.

15. A sensor, comprising:

a sensor member made of a nanoparticle ink deposited on a substrate that is plasma treated and that is made of a dielectric material, wherein the sensor member is configured to detect radiation in its surrounding environment, wherein the sensor member is substantially in direct contact with the substrate, wherein the nanoparticle ink comprises:

(a) a solvent; and (b) nanotubes suspended in the solvent, wherein each of the nanotubes has an open end portion including a functional group that is chemically bonded with the functional group of another nanotube of the nanotubes;

wherein the nanotubes in the sensor member are connected to each other through the chemical bonding of the functional groups and form a single conductive structure having a length in an order of centimeters, wherein the sensor member functions as an antenna member operating in the microwave range.

16. The antenna of claim 1, wherein the antenna member has a length greater than about 1 cm.

17. An article of manufacture, comprising:

a member made of a nanoparticle ink deposited on a substrate made of a dielectric host medium, wherein the nanoparticle ink comprises:

(a) a solvent; and (b) conducting nanotubes suspended in the solvent, wherein each of the nanotubes has an open end portion including a functional group that is chemically bonded with the functional group of another nanotube of the nanotubes;

wherein the nanotubes in the member are connected to each other through the chemical bonding of the functional groups and form a single conductive structure having a length in an order of centimeters, wherein the member functions as an antenna member operating in the microwave range; and wherein the single conductive structure are arranged to detect a change in radiation in a surrounding environment and, in response, transmit electromagnetic waves signaling the change in radiation.

* * * * *